US007101022B2

(12) United States Patent
Mui et al.

(10) Patent No.: US 7,101,022 B2
(45) Date of Patent: Sep. 5, 2006

(54) ATTACHABLE AND DETACHABLE CONTINUOUSLY SUPPLYING INK CONTAINER

(75) Inventors: Ho Leung Mui, Guangdong (CN); Jin Benyou, Guangdong (CN)

(73) Assignee: Print-Rite. Unicorn Image Products Co., Ltd. of Zhuhai, Guangdong (CN)

( * ) Notice: Subject to any disclaimer, the term of this patent is extended or adjusted under 35 U.S.C. 154(b) by 32 days.

(21) Appl. No.: 10/964,075

(22) Filed: Oct. 13, 2004

(65) Prior Publication Data

US 2005/0110849 A1 May 26, 2005

(30) Foreign Application Priority Data

Oct. 14, 2003 (CN) ..... 2003 2 0117037

(51) Int. Cl.
*B41J 2/14* (2006.01)

(52) U.S. Cl. ..... 347/49

(58) Field of Classification Search ..... 347/49, 347/84, 85, 86, 87, 93
See application file for complete search history.

(56) References Cited

U.S. PATENT DOCUMENTS 4,272,773 A * 6/1981 Halasz ..... 347/86
4,700,202 A * 10/1987 Kuranishi et al. ..... 347/86
5,148,194 A * 9/1992 Asai et al. ..... 347/49
5,409,138 A * 4/1995 Nakano ..... 222/64
6,267,475 B1 * 7/2001 Lee et al. ..... 347/86

* cited by examiner

*Primary Examiner*—Anh T. N. Vo
(74) *Attorney, Agent, or Firm*—Fay, Sharpe, Fagan, Minnich & McKee, LLP

(57) ABSTRACT

An attachable and detachable continuously supplying ink container comprises two or more shell bodies that are separated from each other and substantially sealed. Each shell body is provided with an ink filling port having a cap, an air filter and an ink outlet port. Each shell body may form a continuously supplying ink container after it has been filled with ink. The ink container can supply ink to a corresponding print head or cartridge by means of a tube being connected with its ink outlet port. Each shell body of the ink continuously supplying container is provided with a connecting part for connecting an adjacent shell body of the continuously supplying ink container. Several shell bodies may be connected to each other and form a unit via the connecting parts. Accordingly, this provides convenience of use and a reduction of manufacturing cost and user cost.

14 Claims, 7 Drawing Sheets

ATTACHABLE AND DETACHABLE CONTINUOUSLY SUPPLYING INK CONTAINER

BACKGROUND

The present invention relates to an ink-supplying container for an ink jet printer, especially to a continuously supplying ink container of an attachable and detachable type.

An ink jet printer generally utilizes an ink cartridge containing a certain amount of ink as an ink supply source. For users who frequently print large numbers of pages, frequent replacement of the ink cartridge is necessary and inconvenient. One solution for reducing the frequency of the ink cartridge is a relatively large container used for containing ink. Ink from the larger container is directly supplied to the ink cartridge or the print head via a tube. This solution has effectively solved the problem of replacing the ink cartridge frequently. However, a color printer may require a four-color, six-color, or seven-color ink cartridge depending on different design requirements. Therefore, the prior art requires four, six or seven containers separated from each other. The separated containers contain ink liquid of different colors. The advantage of this solution is only one set of manufacturing moulds are required. However, the containers are separated from each other which makes this solution inconvenient to use.

In order to solve the problem described above, another solution has been proposed which uses a unitary ink cartridge. This solution is convenient to use, but the manufacturers must produce several sets of the moulds, such as a four-color unitary mould, six-color unitary mould, seven-color unitary mould and so on. Although this solution is convenient to use, it is relatively expensive to manufacture and use.

BRIEF DESCRIPTION

An aim of the present invention is to provide a continuously supplying ink container having a standard connecting part. The desired number of ink supplying containers can be combined conveniently into a unit depending on the type of printer.

In order to achieve the aim described above, the present invention provides a solution comprising two or more shell bodies that are separated from each other and substantially sealed. Each shell body is provided with an ink filling port including a cap, an air filter and an ink outlet port. Each shell body can form a single-color continuously supplying ink container after being filled with ink. The ink is supplied to a corresponding print head or ink cartridge with a tube connected from the shell body ink outlet port. Each shell body of the continuously supplying ink container is provided with a connecting part for connecting with an adjacent shell body of the continuously supplying ink container. Several shell bodies can be connected with each other and form a unit via the connecting parts. This combination of shell bodies will provide a continuously supplying ink container for multiple types of printers.

As can bee seen from the above solution, the present invention has provided a connecting part that is provided on the container and used for connecting the containers with each other. Therefore, only one set of manufacturing moulds are required. To produce a continuously supplying ink container for a specific printer, the producer is only required to combine the desired number of shell bodies into a unit based on the number of ink colors of the specific printer and fill the colored ink into the corresponding shell body. Compared with the prior art, the operating method of this container is similar to a unitary ink supply container resulting in convenience of use. In addition, the operating method of this container provides a reduction in manufacturing cost and usage cost.

DETAILED DESCRIPTION

The present invention is made obvious by the following description combined with the following drawings and the preferred embodiments.

Figure 1:
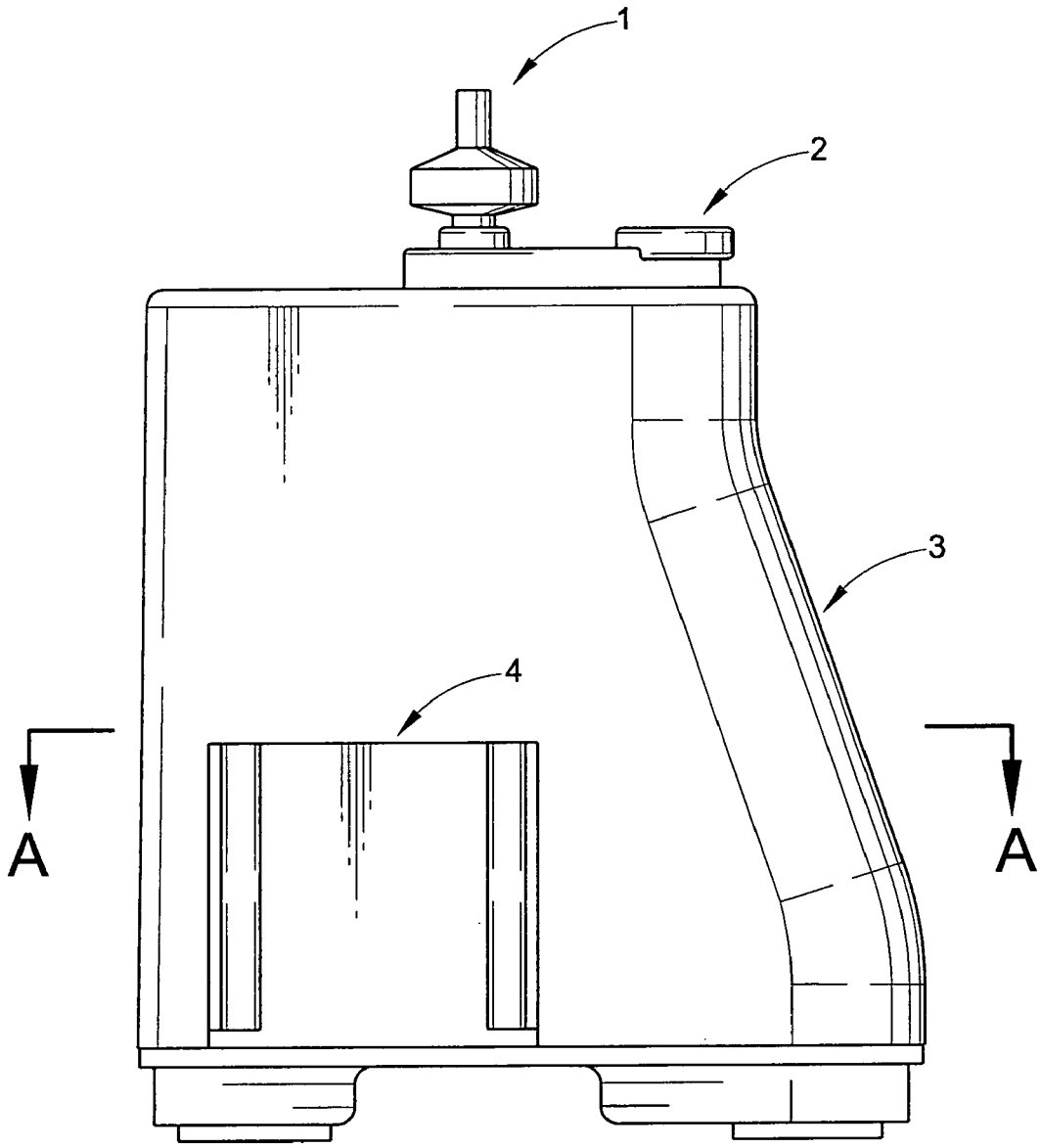
FIG. 1 is a front view showing a shell body of one container of the present invention.

Referring to FIG. 1, shown is a front view of a shell body 3 of a container according to one embodiment of the invention. The shell body 3 is a container that is substantially sealed and contains ink therein. In addition, it is generally made of transparent or semitransparent material for observing the ink amount in the container. Observation of the ink amount in the container is important for refilling the container with ink in a timely manner. An air filter 1 is attached at the upper part of the shell body 3. As the ink is being consumed, air is introduced into the container after it has been filtered by the air filter 1. Consequently, it is possible to maintain a substantially stable pressure in the container. Furthermore, an ink filling port 2 with a cap is used for supplying ink into the container and an ink outlet port (not shown) is provided at the bottom part. Also shown in FIG. 1 is a connecting part 4 for combining and connecting with the shell body an adjacent container.

Figure 2:
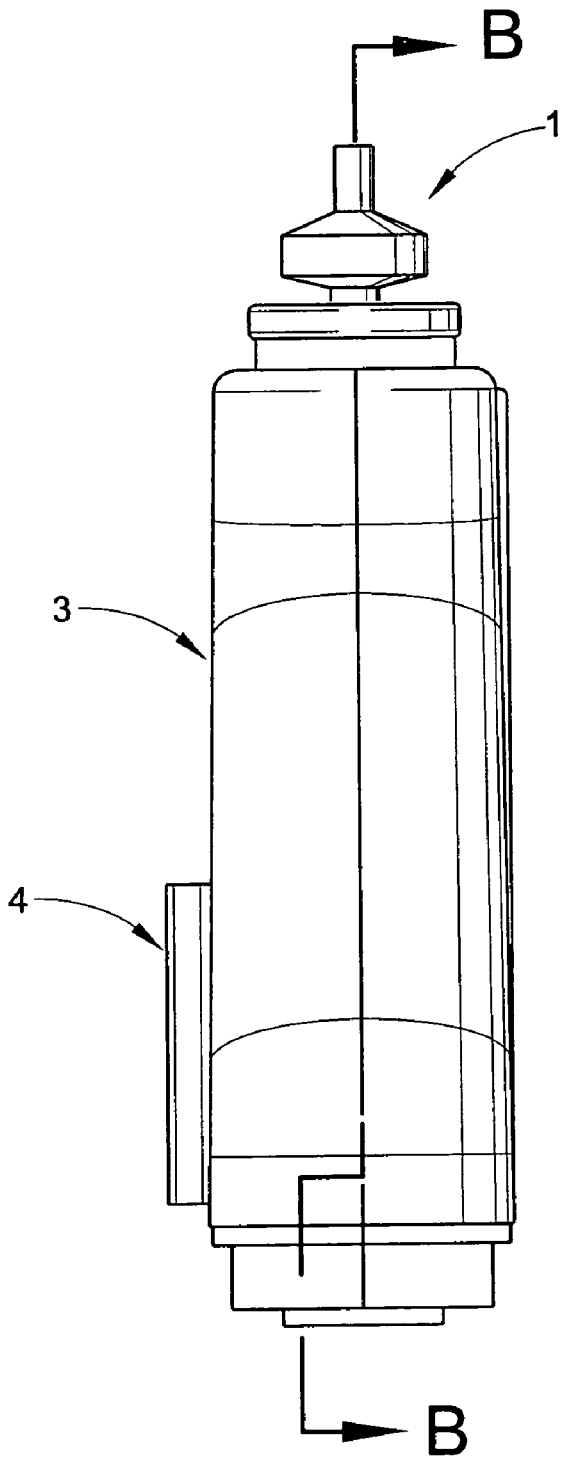
FIG. 2 is a right side view of a shell body as shown in FIG. 1.

As shown in FIG. 2, the shell body 3 has two substantial flat side faces, on either of which a connecting part is provided for combining and connecting with the adjacent shell body. The connecting part 4 is a joggle projecting from one side face, while the connecting part on the other side face is a recess (not shown in FIG. 2) that fits into the joggle of the connecting part 4.

Figure 3:
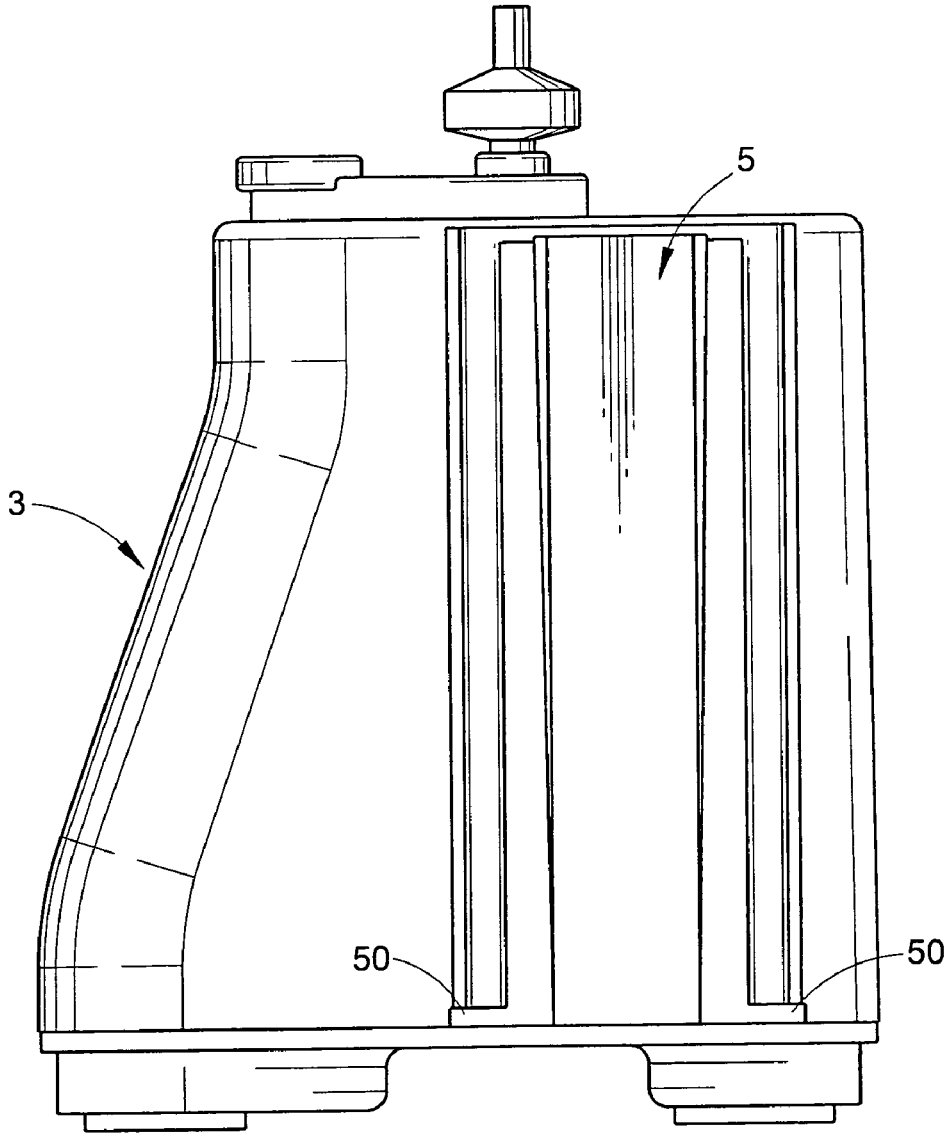
FIG. 3 is a back view of a shell body as shown in FIG. 1.

Referring to FIG. 3, the connecting part 5 that fits into the joggle is provided on the indicated side face of the shell body 3. The connecting part 5 includes a recess arranged to extend in the same direction as the joggle and be parallel with the joggle on the other side face. The joggle of another shell body can be inserted downright into the recess of this shell body. The inserted joggle is stopped during its downward motion by a circular bead 50 to position the joggle within the mating recessed connecting part 5.

Figure 4:
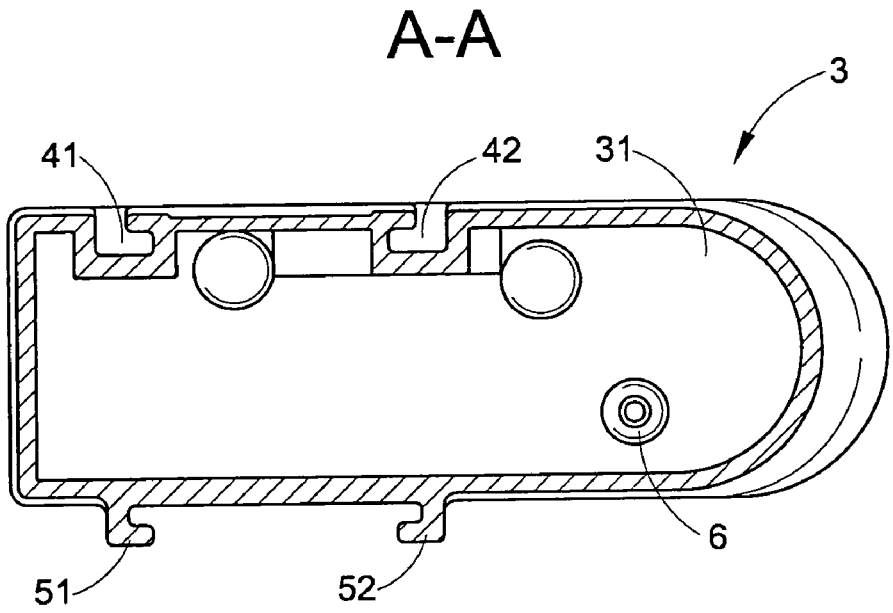
FIG. 4 is the A—A sectional view as indicated in FIG. 1.

Referring to FIG. 4, shown is an ink-containing chamber 31 in the shell body 3. In addition, an ink outlet port 6 is provided that includes a tube (not shown) which projects out from the shell body 3 and connects to a flexible pipe supplying ink to the print head. A pair of recesses 41 and 42 are provided on the top face of this figure and a pair of joggles 51 and 52 matching recesses 41 and 42 are provided on the bottom face of this figure.

Figure 5:
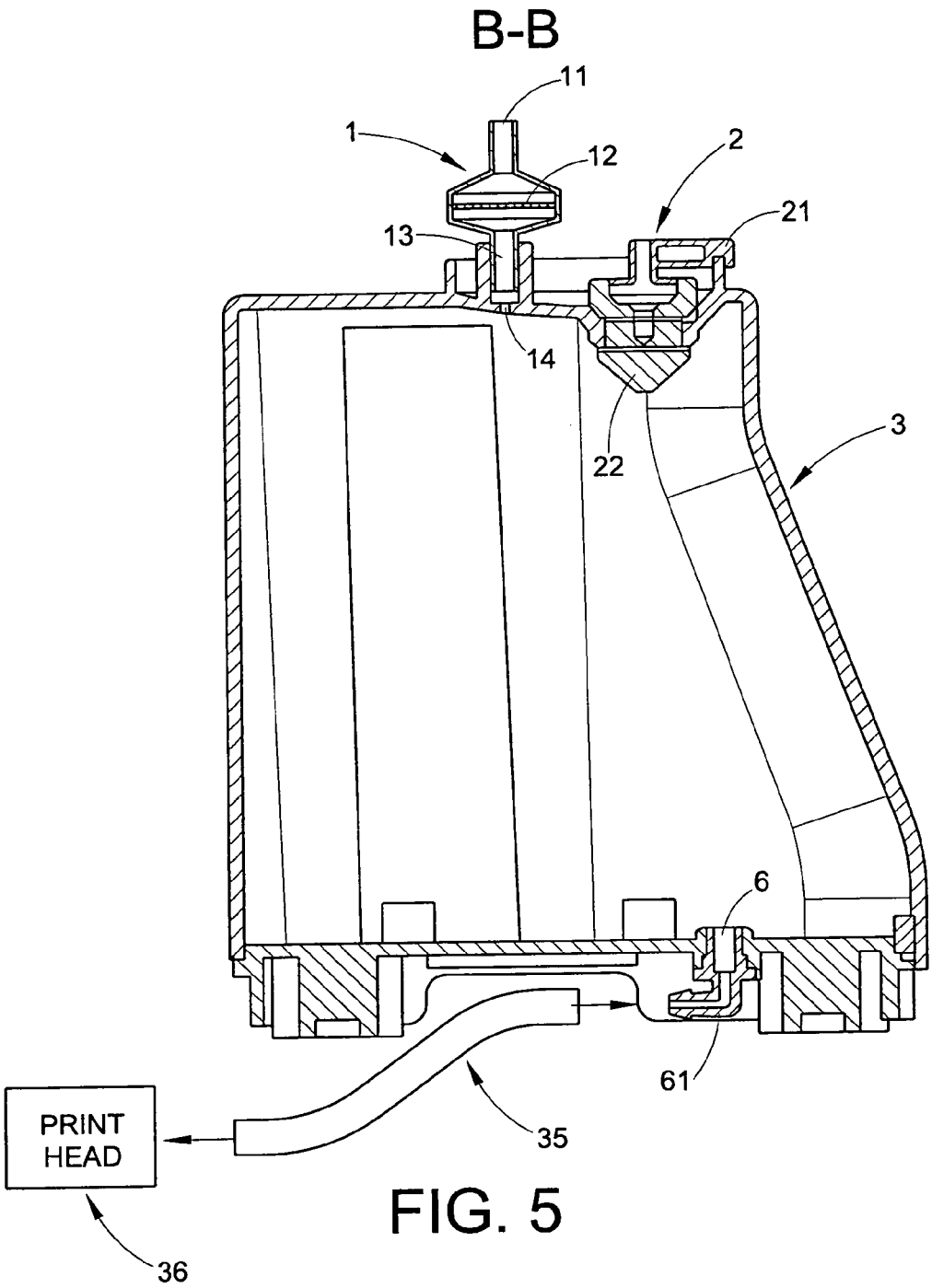
FIG. 5 is the B—B sectional view as indicated in FIG. 2.

Referring to FIG. 5, the filter 1 is a tubular revolving body having a variable cross section and is comprised of an upper tube body 11 connecting with the atmosphere, a filter screen 12 disposed at the center of the filter 1 and a lower tube body 13 which is hermetically secured tightly to the inside face of a tube base on the shell body 3. There is an air hole 14 at the lower end of the tube base. The cap 2 is comprised of a hand-carrying ring 21 and a cap header 22. The cap 2 is opened to pour ink into the container and closed to plug up and seal the ink outlet port on the shell body 3. An ink outlet tube 6 is located at the bottom part of the shell body 3 and includes a bent tube mouth 61 which may be hermetically inserted into the tube mouth of a flexible tube 35 to form an end to end joint. The flexible tube 35 supplies ink to a print head 36.

Figure 6:
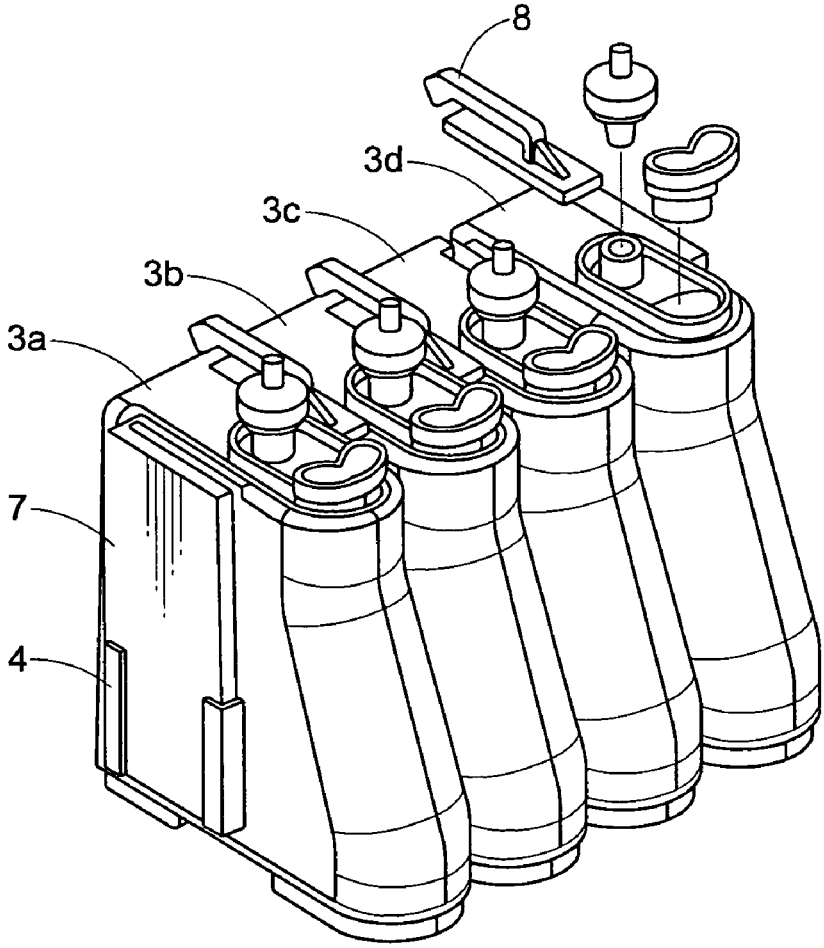
FIG. 6 is a view showing a four-color combined container.

Referring to FIG. 6, shown is an embodiment of a continuously supplying ink container of a four-color combined type according to the present invention. Four shell bodies 3*a*, 3*b*, 3*c*, 3*d* are combined into a unit sequentially via their respective connecting parts in the manner described above. In addition, a fixed mount 8 for an ink tube may be attached to the top parts of every adjacent pair of shell bodies. The fixed mount 8 has two functions. Firstly, it prevents the connecting part from separating from the matching joggle after the fixed mount 8 is attached to the adjacent top parts of two shell bodies. The two shell bodies become rigidly connected to each other and can not be separated from each other, allowing the whole continuously supplying ink container of four-color combined type to form a rigid body. Secondly, the fixed mount 8 allows for a regular arrangement of the flexible tubes that lead out from the ink outlet ports at the bottom part of the shell bodies. A method for attaching the fixed mount includes adhering each fixed mount 8 to the top parts of adjacent shell, bodies. Furthermore, in order to obtain an esthetic appearance, a decorative inserting plate 7 can be attached to the unconnected connecting part 4 of the shell body 3*a* located at one end and the unconnected connecting part 5 of the shell body 3*d* located on the opposite end.

Figure 7:
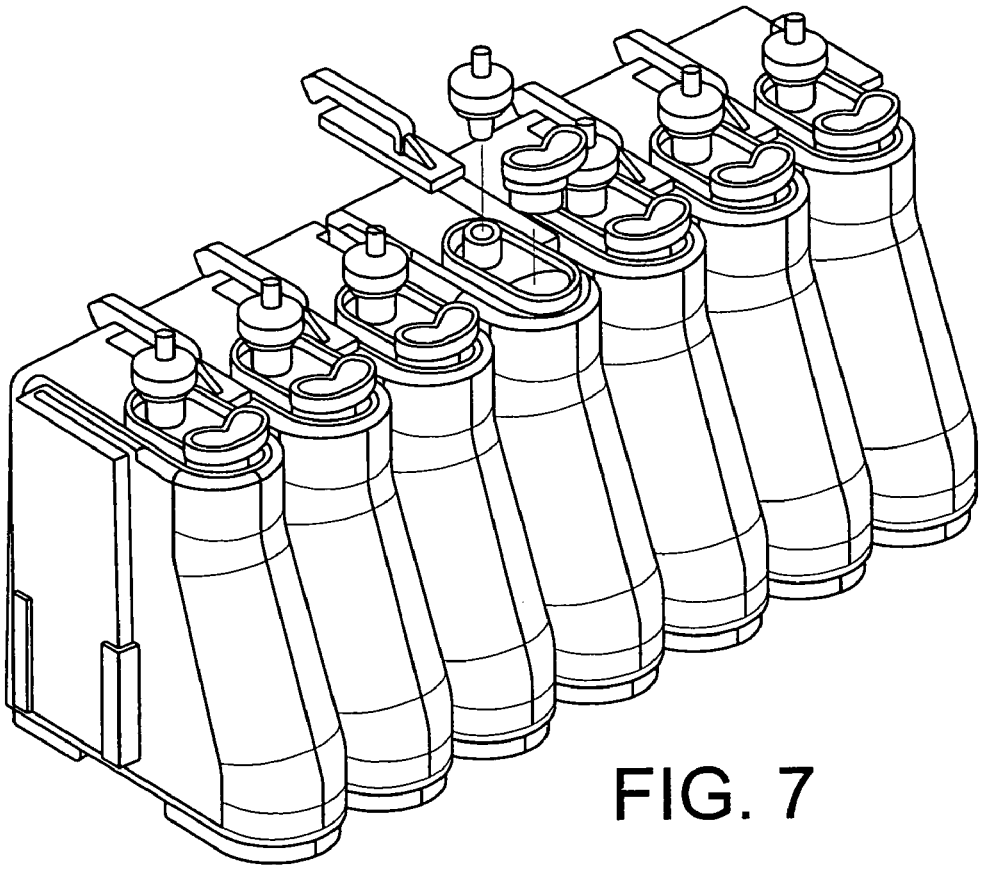
FIG. 7 is a view showing a seven-color combined container.

Referring to FIG. 7, shown is an embodiment of a continuously supplying ink container of a seven-color combined type according to one embodiment of the present invention. This embodiment includes a container having seven shell bodies and can-be used for continuously supplying ink to a printer having seven cartridges.

As can be seen from the above description, only one set of manufacturing moulds is needed to manufacture the container. For a printer using a specific number of colors, simply assemble a container using the desired number of shell bodies and fill colored ink into the corresponding shell bodies. The end result is a decrease in production cost as compared with the prior art.

The design of the present invention is not limited to the above embodiments. For example, the structure of the connecting part may be a pinhole and a pin located on two side faces of the shell body and matched with each other in shape. The two shell bodies are combined with each other by inserting the pin of one shell body to the pinhole of the other shell body.

The invention claimed is:

1. An attachable and detachable continuously supplying ink container, comprising:

two or more shell bodies separated from each other and substantially sealed, each shell body provided with an ink filling port having a cap, an air filter and an ink outlet port;

a fixed mount for mounting an ink tube is provided on a surface adjacent to the surface where a connecting part is located and said fixed mount is used for rigidly connecting two adjacent shell bodies;

wherein, said each shell body of the continuously supplying ink container provides the connecting part to connect with an adjacent shell body of the continuously supplying ink container;

said connecting part is a recess provided on one side face of said each shell body of the continuously supplying ink container and said connecting part is used to connect with said adjacent shell body, and a joggle provided on the other side face of said each shell body is used to connect with said adjacent shell body; and wherein said recess and said joggle are arranged to extend in the same direction and be parallel with each other.

2. The attachable and detachable continuously supplying ink container according to claim 1, wherein said connecting part is a pinhole provided on one side face of said each shell body of the continuously supplying ink container and said pin hole is used for connecting the adjacent shell body, and a pin provided on an other side face of said each shell body of the continuously supplying ink container is used for connecting with the other adjacent said shell body.

3. An attachable and detachable continuously supplying ink container, comprising:

two or more shell bodies provided with an ink filling port having a cap, an air filter and an ink outlet port;

means for separating the two or more shell bodies;

means for sealing the two or more shell bodies;

means for connecting each shell body to an adjacent shell body; and means for mounting a flexible tube to a shell body, wherein the means for mounting the flexible tube also provides a means for connecting said each shell body to the adjacent shell body.

4. The attachable and detachable continuously supplying ink container according to claim 3, further comprising:

an ink tube; and means for connecting the ink tube to the ink outlet port.

5. The attachable and detachable continuously supplying ink container according to claim 4, further comprising:

a flexible tube for supplying ink to the print head; and means for connecting the ink tube to the flexible tube.

6. The attachable and detachable continuously supplying ink container according to claim 5, further comprising:

the print head; and means for connecting the flexible tube to the print head.

7. The attachable and detachable continuously supplying ink container according to claim 3, further comprising:

means for hermetically sealing the air filter to the two or more shell bodies.

8. The attachable and detachable continuously supplying ink container according to claim 3, further comprising:

means for filling the shell body with ink.

9. An attachable and detachable continuously supplying ink container, comprising:

a shell body for storing ink, wherein the shell body includes a top surface, bottom surface and side surfaces;

an ink filling port located on the top surface of the shell body;

an air filter located on the top surface of the shell body, the air filter connecting with the atmosphere and the air filter hermetically connected to a hole on the top surface of the shell body;

an ink outlet port located near the bottom surface of the shell body;

a pair of joggles on a side surface of the shell body;

a pair of recesses on a side surface of the shell body, wherein the pair of recesses mate with a pair of joggles of an adjacent shell body to form a connection of at least two shell bodies; and a fixed mount attached to the top surface of the shell body, wherein the fixed mount prevents the pair of recesses and the pair of joggles of an adjacent shell body from becoming unconnected.

10. The attachable and detachable continuously supplying ink container according to claim 9, further comprising:

an ink tube, wherein the ink tube is hermetically connected to the ink outlet port.

11. The attachable and detachable continuously supplying ink container according to claim 10, further comprising:

a flexible tube, wherein the flexible tube is connected to the ink tube.

12. The attachable and detachable continuously supplying ink container according to claim 9, further comprising:

a print head, wherein the flexible tube connects the print head to the ink tube.

13. The attachable and detachable continuously supplying ink container according to claim 9, wherein the flexible tube is attached to the fixed mount.

14. The attachable and detachable continuously supplying ink container according to claim 9, further comprising:

means for positioning the pair of joggles within the pair of recesses.

* * * * *